United States Patent [19]

Mumford

[11] 4,376,497

[45] Mar. 15, 1983

[54] CHILD RESISTANT DISPENSING CLOSURE

[75] Inventor: George V. Mumford, Toledo, Ohio

[73] Assignee: Owens-Illinois, Inc., Toledo, Ohio

[21] Appl. No.: 187,300

[22] Filed: Sep. 15, 1980

[51] Int. Cl.[3] ..... B67B 5/00

[52] U.S. Cl. ..... 222/153; 215/216; 222/553

[58] Field of Search ..... 215/216, 217; 222/153, 222/548, 553, 555

[56] References Cited

U.S. PATENT DOCUMENTS

| | | | |
|---|---|---|---|
| 1,714,368 | 5/1928 | Hobson . | |
| 2,328,246 | 8/1943 | Albion | 220/253 |
| 3,342,385 | 9/1967 | Knight | 222/548 X |
| 3,357,605 | 12/1967 | Chadfield | 222/548 X |
| 3,467,287 | 9/1969 | Marchant et al. | 222/548 X |
| 3,830,392 | 8/1974 | Kessler et al. . | |
| 3,857,508 | 12/1974 | LaBarge et al. . | |
| 3,894,647 | 7/1975 | Montgomery | 215/216 |
| 4,117,945 | 10/1978 | Mumford . | |
| 4,299,339 | 11/1981 | Giroux et al. | 222/153 |

*Primary Examiner*—H. Grant Skaggs

*Attorney, Agent, or Firm*—John R. Nelson; Myron E. Click; David H. Wilson

[57] ABSTRACT

A snap on child resistant closure has a radial port which may be aligned with a radial port on a cooperating container neck to allow dispensing of granular or pulverulent contents. The closure has a flexible annular skirt provided with a plurality of inwardly projecting lugs. Cooperating outwardly projecting lugs on the container neck normally prevent rotation of the closure to the angular position of alignment of the radial ports. The flexible annular skirt must be squeezed and distorted to disengage the lugs, thereby permitting alignment of the ports.

3 Claims, 6 Drawing Figures

CHILD RESISTANT DISPENSING CLOSURE

BACKGROUND OF THE INVENTION

There are many prior art closures which require some purposeful manipulation, beyond the ability of a child, to permit access to contents of a container. Most such child resistant safety closures have releasable locking means which retain the closure in a sealing relationship to the container, or upon release, permit complete removal of the closure. A particularly effective and simple child resistant closure is known as a "squeeze and turn" closure. An example of such a closure is disclosed in U.S. Pat. No. 4,117,945 to Mumford. Such a closure is threaded onto a cooperative container neck. On the inside of the closure skirt are a plurality of inwarding projecting lugs, which engage a plurality of outwardly projecting lugs formed on the container neck. The interengagement of the two sets of lugs normally prevents the rotational removal of the threaded closure. To remove the squeeze and turn closure, the flexible skirt must be squeezed and distorted to disengage the lugs, thereby permitting rotational removal.

However, for many granular of pulverulent products, it is desirable to provide a relatively small dispensing opening for controlled dispensing of small amounts of contents. Complete removal of the closure may not be necessary. Closures which are rotatable on a container neck to open dispensing ports without removing the closure are not new. See, for example, U.S. Pat. Nos. 2,328,246 to Albion and 1,714,368 to Hobson. Most such dispensing closures, however, have not been child resistant. A child resistant dispensing closure is disclosed in U.S. Pat. No. 3,830,392 to Kessler et al., but the Kessler device requires a relatively complicated manufacturing process. The present invention provides an improved, child-resistant, squeeze and turn closure with a relatively small dispensing opening.

SUMMARY OF THE INVENTION

The invention provides a closure and container combination with a dispensing opening for a free-flowing powdered or granular product. The closure has a circular top panel and a flexible annular skirt depending from the periphery of the panel. A cooperating container neck has an annular retention bead. As the closure is pushed onto the container neck, a second annular retention bead provided on the interior of the closure skirt snaps into position below the retention bead formed on the container neck. The engagement of the retention beads prevents axial removal of the closure, but permits rotational movement of the closure on the container neck.

The closure skirt has a radially opening port or dispensing opening arranged to align with a corresponding opening in the container neck when the closure is rotated to the proper angular position on the neck. The flexible closure skirt has a set of inwardly projecting lugs, which engage corresponding outwardly projecting locking lugs formed on the container neck. The interengagement of these locking lugs normally prevents the rotation of the closure to the position of alignment of the radial dispensing ports. To rotate the closure to the open position, the flexible skirt must first be squeezed and distorted to disengage the locking lugs.

DESCRIPTION OF THE PREFERRED EMBODIMENT

Figure 1:
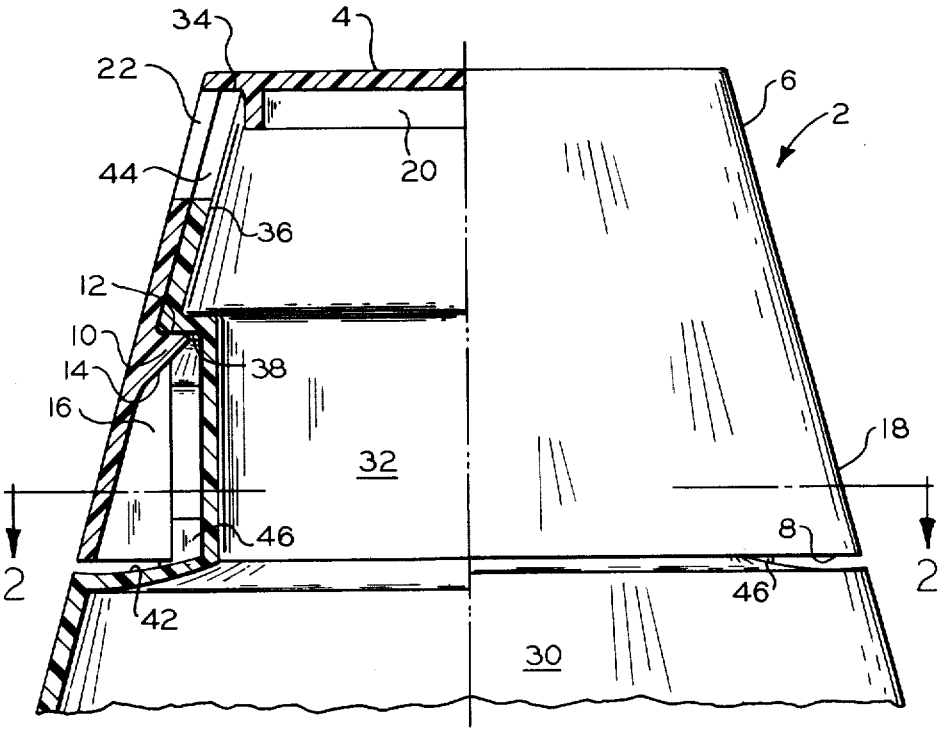
FIG. 1 is an elevational view, partly in section, showing a closure and container neck embodying the present invention, with the dispensing ports in alignment.

Referring to the drawings, the invention comprises a child-resistant package consisting of a closure 2 and a cooperating container 30. The closure has a top circular panel 4, and an integral, annular skirt 6 depending from the periphery thereof. The skirt 6 is tapered downwardly and outwardly from the panel 4 to lower circular edge 8.

On the interior surface of the skirt 6, located approximately midway between the panel 4 and the lower edge 8 of the skirt 6, is an inwardly projecting closure retention bead 10. The retention bead 10 has a top surface 12 which is generally horizontal, and parallel to the panel 4. The lower surface 14 of the retention bead 10 tapers downwardly and outwardly.

Figure 6:
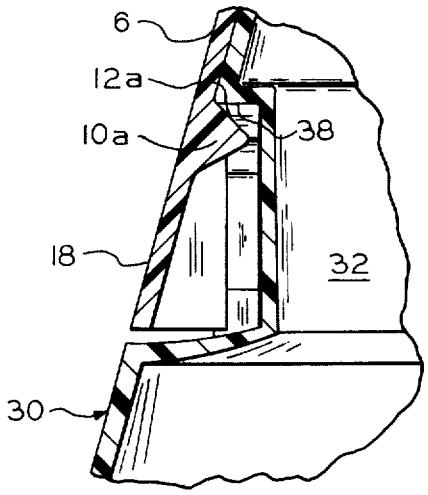
FIG. 6 is a fragmentary sectional view, similar to FIG. 1, illustrating an alternative embodiment in which the closure retention bead top surface slopes inwardly and downwardly.

A retention bead of this configuration will most reliably retain the closure 2. However, a relatively expensive mold construction would be necessary to form the abrupt projection defining the upper surface 12 of the retention bead 10. Alternatively, therefore, a bead **10*a* having a top surface 12*a* which slopes downwardly and inwardly may be used, as illustrated in FIG. 6. A top surface 12*a* which slopes downwardly 50° from the horizontal will retain the closure 2** in normal usage, yet will permit a mold member to be axially stripped from the closure during manufacture.

On the interior surface of the skirt 6, and below the retention bead 10, are two inwardly projecting, diametrically located, locking lugs 16. At least the lower portion 18 of the skirt 6, from which the lugs 16 project, must have some degree of flexibility, therefore permitting the locking lugs 16 to be moved radially in and out, by hand pressure.

Depending from the lower, inside surface of the panel 4, is an annular reinforcing plug 20. A radially opening port 22 is formed at the top of the skirt 6, adjacent to the panel 4. The port 22 extends below the lower edge of the annular reinforcing plug member 20, so that the plug member 20 does not interfere with the flow of contents through the port 22. The port 22 is located directly above one of the locking lugs 16.

A container 30 which cooperates with the closure 2 to form a child-resistant package has an annular neck 32 defining a rim 34. The neck 32 has a conical surface 36 which tapers downwardly and outwardly from the rim 34 to a downwardly facing horizontal shoulder or retention bead 38. Below the retention bead 38, the neck 32 is recessed to define a lower cylindrical portion 40. Below the recessed portion 40 of the neck 32, an upwardly facing, generally horizontal surface 42 is formed.

The neck is provided with a radially opening port 44 at the top of the tapered neck section 36, adjacent the rim 34. Two pairs of closely spaced locking lugs 46 project outwardly from the recessed cylindrical portion 40, adjacent the horizontal surface 42. The pairs of lugs 46 are diametrically located, and one pair is located directly below the port 44. Therefore, a vertical plane extending through the port 44 and the axis of the neck 32 passes also through the respective spaces between the pairs of closely spaced lugs 46.

The closure 2 is assembled onto the container 30 by pushing it downwardly onto the container neck 32. As the closure 2 is pushed into position, the retention bead 10 is forced outwardly by the tapered conical surface 36, thereby flexing the skirt 6. This sliding motion of the bead 10 down the tapered surface 36 is facilitated by the tapered surface 14 of the retention bead 10. As the retention bead 10 passes the retention bead 38, the bead 10 snaps radially inwardly beneath the retention bead 38. Removal of the closure 2 from the container neck 32 is therefore prevented by the engagement of the upper horizontal surface 12 of the retention bead 10 and the downwardly facing horizontal shoulder of the retention bead 38. The distance from the rim 34 to the retention bead 38 is approximately the same as the distance from the closure panel 4 to the locking surfaces 12. Therefore, little or no axial movement between the closure 2 and the container neck 32 is possible, but the closure 2 may be rotated on the container neck 32.

Alternatively, a plurality of inwardly projecting retention lugs could be employed in place of the bead 10. Such lugs would in effect constitute a discontinuous retention bead. However for most reliable retention of the closure 2, the continuous bead 10 is preferred.

Below the retention bead 10, the locking lugs 16 formed on the flexible lower skirt 18 project inwardly into the recess in the neck 32 defined by the cylindrical neck portion 40 below the retention bead 38. The container locking lugs 46 extend outwardly a sufficient distance to engage the closure locking lugs 16. Therefore, the engagement of the locking lugs 46 and 16 normally prevents complete rotation of the closure 2 on the container neck 32, rendering it impossible to align the ports 44 and 22 by mere rotation of the closure 2. However, if the flexible skirt portion 18 is squeezed towards the recessed neck portion 40, at points circumferentially spaced 90° from the port 22, the skirt cross section is thereby distorted from a circular to an oval shape. The locking lugs 16 are moved radially outwardly by such squeezing motion to such an extent that they will no longer interfere with the container locking lugs 46. It is then possible to rotate the closure 2 on the container neck 32 to bring the ports 22 and 44 into alignment. The squeezing pressure may then released. In this position, each locking lug 16 is located between the pairs of locking lugs 46. Contents may be poured through the container neck 32, through the port 44, and out the closure port 22. To reseal the container, the closure 2 need only be rotated on the container neck 32. Camming surfaces 47 on the container locking lugs 46 force the closure locking lugs 16 radially outward. As the locking lugs 16 slide past the locking lugs 46 they snap inwardly, and are again prevented from alignment with the port 44 by the interference with the lugs 46.

When the closure 2 is in place on the container neck 32, the lower circular edge 8 of the skirt 6 lies adjacent the upwardly facing shoulder 42 on the neck 32. The proximity of the skirt edge 8 to the shoulder 42 makes it extremely difficult for a child to pry the closure 2 from the container 30. Entry of contamination into the container 30 is also prevented by the cooperation of the skirt edge 8 and shoulder 42.

The seal between the closure 2 and the container neck 32 is formed by the flush fit of the upper portion of the skirt 6 against the tapered neck portion 36. This surface abutment is sufficiently tight to prevent leakage of the powdered or granular contents through the port 44 when the port 44 is not aligned with the port 22. The annular rim 34 also forms a seal against the inside surface of the panel 4. The reinforcing plug 20 reinforces the rim 34 and thus prevents the tapered neck portion 36 from being compressed radially, thereby maintaining the seals. The plug 20 also stiffens the closure 2 and tapered neck 36 to some extent, making removal of the closure 2 more difficult.

Figure 2:
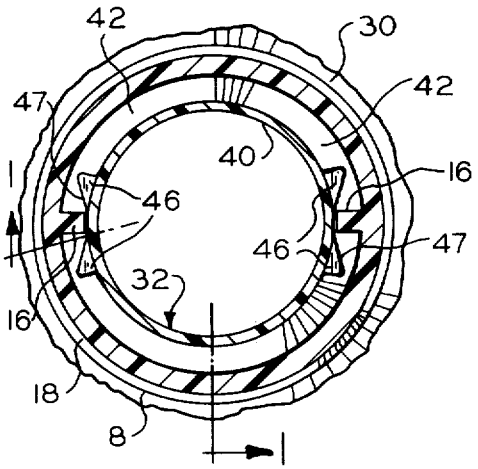
FIG. 2 is a sectional view taken on line 2—2 of FIG. 1.
Figure 3:
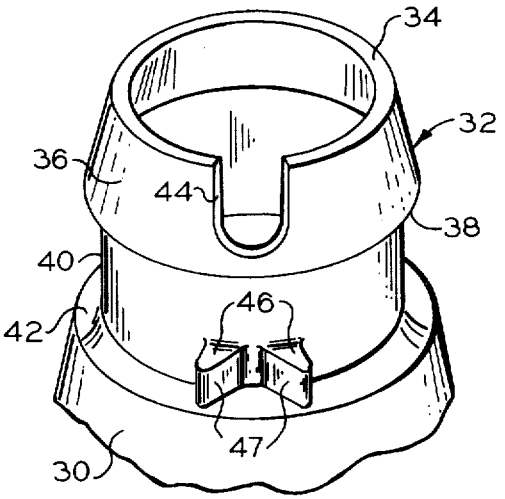
FIG. 3 is a perspective view of the container neck shown in FIGS. 1 and 2, shown without the closure.

The above described embodiments are suitable for uses in which the customer has no need to completely remove the dispensing closure 2. In some applications, however, it may be desired to completely remove the closure for gross pouring. In the alternative embodiment illustrated in FIGS. 4 and 5, structures of the container neck 32*a* similar to those illustrated in FIGS. 1-3 are designated by similar numerals having the suffix "a". The closure 2 may be pried off the neck 32*a* by an upwardly directed force exerted on the locking lugs 16 by two ramps 50 formed on the container shoulder 42*a*. Each ramp 50 extends circumferentially above a segment of the shoulder 42*a*, and slopes upwardly in a counterclockwise direction when viewed from the top of the container 30*a*. The upper surface 52 of the ramp lies generally on a helical line around the cylindrical neck portion 40*a*. The ramps 50 have a width less than the width of the shoulder 42*a*, and less than the inside diameter between the closure locking lugs 16, thereby allowing clearance for the lugs 16 to rotate past the ramps 50. However, if the lugs 16 are pressed inwardly by squeezing the flexible skirt portion 18 as the closure 2 is rotated, the lugs 16 will be cammed upwardly by the ramps 50. The ramps 50 and lugs 16 function as camming members to push the closure 2 from the neck 32*a*. Continued rotation while the lugs 16 engage the ramps 50 will lift the closure 2, and disengage the retention beads 38*a* and 10, thereby permitting complete removal of the closure 2.

Figure 4:
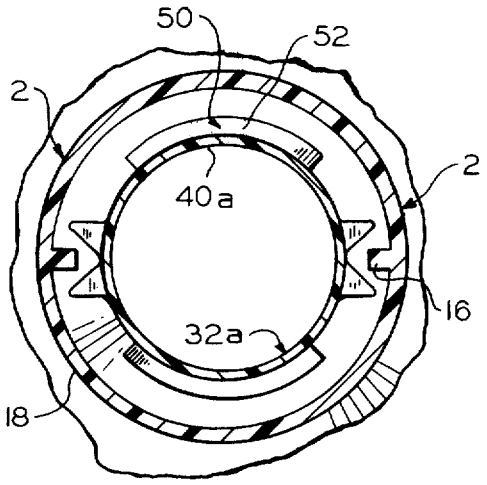
FIG. 4 is a sectional view, similar to FIG. 2, of an alternative embodiment of a container neck, in which camming ramps are provided for removal of the closure.
Figure 5:
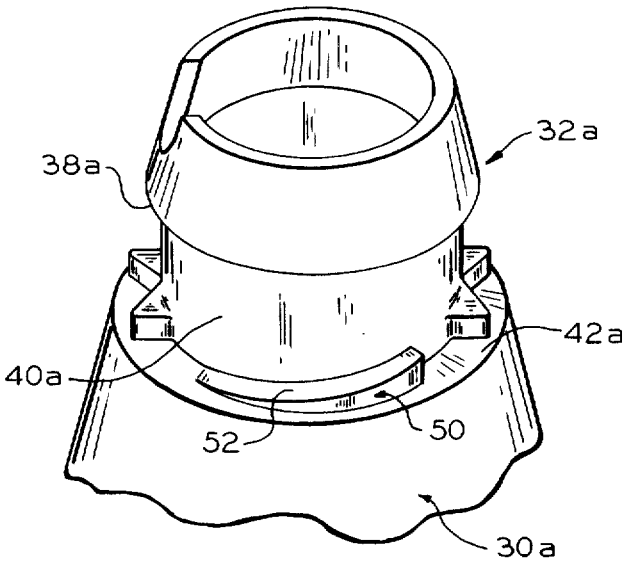
FIG. 5 is a perspective view of the alternative container neck illustrated in FIG. 4, shown without the associated closure.

Thus by manipulation of the closure 2, the user may rotate the closure to align ports 22 and 44, as illustrated in FIG. 4, or may completely remove the closure 2. By squeezing the flexible skirt portion 18 at points spaced from the lugs 16, the lugs are moved radially outwardly, permitting the closure to be rotated to the position illustrated in FIG. 4. In the modification of FIGS. 5 and 6, further squeezing of the skirt 18 adjacent the lugs 16 will cause the lugs 16 to be moved inwardly to engagement with the ramps 50, thereby permitting the closure 2 to be cammed upwardly from the neck 32*a* by the ramps 50 by further rotation of the closure 2 relative to the container.

The closure 2 is preferably molded from an elastomeric plastic material, such as polyethylene, or polypropylene, which will provide the flexibility required in the lower skirt 18.

From the foregoing detailed description, it is apparent that the invention provides a simple yet efficient child-resistant package with a dispensing opening, for dangerous granular or powered products such as household cleaning agents, for example. A dispensing opening may be conveniently exposed by special manipulation of the closure without separating the closure 2 and the container 30.

In view of the foregoing detailed description, modifications of this invention will be apparent to those skilled in the art, and it is intended that the scope of the invention be determined solely by the appended claims.

What is claimed is:

1. A child resistant package comprising, in combination, a container having an annular neck and a closure fitted on said neck, said container neck having a radially disposed discharge port and a downwardly facing shoulder, said closure comprising a panel section and an annular skirt depending from the periphery of said panel section molded from an elastomeric material, means on the skirt of said closure for engaging said shoulder to retain said closure on said neck against axial displacement but permitting rotational movement of said closure relative to said neck, said closure having a radial dispensing port formed in said annular skirt, a pair of diametrically opposed cooperating detent and notch means formed on the said annular skirt of the closure and on said container neck to secure said closure to said container neck in a position where said radial ports are mis-aligned, said annular skirt of said closure being radially deformable by manual application of a squeezing force intermediate said pair of detent and notch means to release said detent from said notch to permit rotational alignment of said closure dispensing port with said container neck dispensing port, an upwardly facing camming surface outwardly projecting from said neck, and a downwardly facing camming surface inwardly projecting from said skirt, said camming surface being engageable only when said elastomeric skirt is manually squeezed to move said downwardly facing camming surface radially inwardly, at least one of said camming surfaces having a generally helical shape, whereby rotation of said closure relative to said neck while said camming surfaces are engaged will cam said closure upwardly off said neck.

2. The container and closure combination of claim 1 wherein said means on said closure skirt for retaining said closure comprises an annular retention bead internally projecting from said skirt, and constructed and arranged to project underneath said downwardly facing shoulder.

3. A child resistant package comprising, in combination, a container having an annular neck and a closure fitted on said neck, said container neck having a radially disposed discharge port and a downwardly facing shoulder, said closure comprising a panel section and an annular skirt depending from the periphery of said panel section molded from an elastomeric material, means on the skirt of said closure for engaging said shoulder to retain said closure on said neck against axial displacement but permitting rotational movement of said closure relative to said neck, said closure having a radial dispensing port formed in said annular skirt, a pair of diametrically opposed cooperating detent and notch means formed on the said annular skirt of the closure and on said container neck to secure said closure to said container neck in a position where said radial ports are mis-aligned, said detent and notch means comprising a pair of radial lugs internally projecting from the inside surface of said skirt, and a pair of notches defined on said container neck by outwardly projecting lugs, said annular skirt of said closure being radially deformable by manual application of a squeezing force intermediate said pair of detent and notch means to release said detent from said notch to permit rotational alignment of said closure dispensing port with said container neck dispensing port, and ramp members formed on said container neck intermediate said outwardly projecting lugs, said radial lugs on said closure skirt having bottom surfaces engageable with said ramps only when said flexible skirt is manually squeezed and said closure radial lugs are moved radially inwardly, whereby rotation of said closure relative to said neck while said lugs engage said ramps will cam said closure upwardly relative to said container neck and over said downwardly facing shoulder.

* * * * *